US008979227B2

(12) United States Patent
Blowfield et al.

(10) Patent No.: US 8,979,227 B2
(45) Date of Patent: Mar. 17, 2015

(54) CONTAINER AND METHOD FOR LIQUID STORAGE AND DISPENSING

(71) Applicant: Videojet Technologies Inc., Wood Dale, IL (US)

(72) Inventors: Philip Blowfield, Kettering (GB); Tomlin Matthew, Cambridge (GB); Mann Carl, St. Ives (GB)

(73) Assignee: Videojet Technologies Inc., Wood Dale, IL (US)

( * ) Notice: Subject to any disclaimer, the term of this patent is extended or adjusted under 35 U.S.C. 154(b) by 0 days.

(21) Appl. No.: 14/038,152

(22) Filed: Sep. 26, 2013

(65) Prior Publication Data

US 2014/0292844 A1 Oct. 2, 2014

Related U.S. Application Data

(62) Division of application No. 12/680,919, filed as application No. PCT/GB2008/003403 on Sep. 10, 2008.

(30) Foreign Application Priority Data

Oct. 12, 2007 (GB) ..... 0720288

(51) Int. Cl.
*B41J 2/195* (2006.01)
*B41J 2/175* (2006.01)

(52) U.S. Cl.
CPC ..... *B41J 2/17566* (2013.01); *B41J 2/175* (2013.01); *B41J 2/17553* (2013.01); *B41J 2/17556* (2013.01)
USPC ..... 347/7; 347/86

(58) Field of Classification Search
CPC ..... B41J 2/17566; B41J 2/17513; B41J 2/17546; B41J 2/17509; B41J 2/1752
USPC ..... 347/7, 5, 86
See application file for complete search history.

(56) References Cited

U.S. PATENT DOCUMENTS

| | | | | |
|---|---|---|---|---|
| 6,116,723 | A * | 9/2000 | Childers | 347/85 |
| 6,481,837 | B1 * | 11/2002 | Askren et al. | 347/85 |
| 6,585,359 | B1 * | 7/2003 | Gasvoda et al. | 347/86 |
| 2004/0135854 | A1 | 7/2004 | Kuwabara | |
| 2005/0120792 | A1 * | 6/2005 | Merrild | 73/303 |
| 2007/0103522 | A1 * | 5/2007 | Hashii et al. | 347/86 |
| 2007/0145059 | A1 | 6/2007 | Ogura | |
| 2007/0145076 | A1 * | 6/2007 | Yamada et al. | 222/189.09 |

* cited by examiner

*Primary Examiner* — Manish S Shah
*Assistant Examiner* — Yaovi Ameh
(74) *Attorney, Agent, or Firm* — Joseph A. Yosick

(57) ABSTRACT

A method for measuring the volume of liquid, such as ink or solvent, remaining in a container, such as a replacement cartridge for a continuous ink jet printer, uses a reservoir enclosing an internal space having a variable volume for storage. The reservoir is adapted to provide a reduction in the pressure of the internal space, the reduction substantially monotonically increasing in magnitude as liquid is drawn into the printer, such that the volume of liquid remaining may be calculated from knowledge of the minimum withdrawal pressure required to draw further liquid from the reservoir into the printer. Containers for use with the method have a liquid dispensing port adapted to allow liquid to be dispensed when a withdrawal pressure at the exterior of the port is less than the pressure of the internal space and adapted to prevent the ingress of air into the internal space of the reservoir as liquid is dispensed.

10 Claims, 2 Drawing Sheets

CONTAINER AND METHOD FOR LIQUID STORAGE AND DISPENSING

CROSS REFERENCE TO RELATED APPLICATIONS

Figure 1:
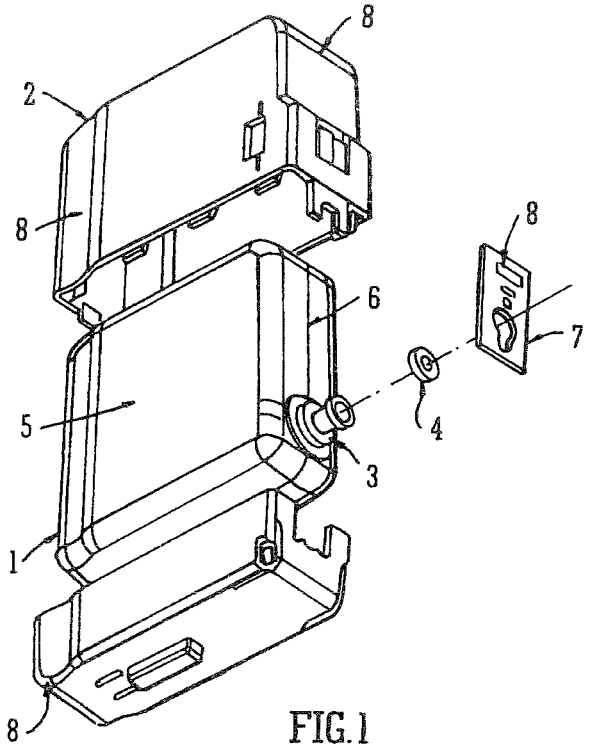

This application is a Divisional of U.S. application Ser. No. 12/680,919 filed Mar. 31, 2010 which claims priority under 35 U.S.C. §371 from PCT Application No. PCT/GB2008/0003403, filed in English on Oct. 9, 2008, which claims the benefit of GB Patent Application No. 0720288.0 filed Oct. 12, 2007, the disclosures of which are incorporated herein by reference in their entireties.

The present invention relates to containers for dispensing liquids, particularly refill containers for dispensing inks or solvents for use in printers, such as ink jet printers, particularly continuous ink jet printers. The invention also relates to methods for monitoring the amount of liquid remaining in such containers and to an ink jet printer connectable to a container of the kind referred to above.

In ink jet printing systems the print is made up individual droplets of ink generated at a nozzle and propelled towards a substrate. There are two principal systems: drop on demand where ink droplets for printing are generated as and when required; and continuous ink jet printing in which droplets are continuously produced and only selected ones are directed towards the substrate, the others being recirculated to an ink supply.

Continuous ink jet printers supply pressurised ink to a print head drop generator where a continuous stream of ink emanating from a nozzle is broken up into individual regular drops by an oscillating piezoelectric element. The drops are directed past a charge electrode where they are selectively and separately given a predetermined charge before passing through a transverse electric field provided across a pair of deflection plates. Each charged drop is deflected by the field by an amount that is dependent on its charge magnitude before impinging on the substrate whereas the uncharged drops proceed without deflection and are collected at a gutter from where they are recirculated to the ink supply for reuse. The charged drops bypass the gutter and hit the substrate at a position determined by the charge on the drop and the position of the substrate relative to the print head.

Typically the substrate is moved relative to the print head in one direction and the drops are deflected in a direction generally perpendicular thereto, although the deflection plates may be oriented at an inclination to the perpendicular to compensate for the speed of the substrate (the movement of the substrate relative to the print head between drops arriving means that a line of drops would otherwise not quite extend perpendicularly to the direction of movement of the substrate).

In continuous ink jet printing a character is printed from a matrix comprising a regular array of potential drop positions. Each matrix comprises a plurality of columns (strokes), each being defined by a line comprising a plurality of potential drop positions (e.g. seven) determined by the charge applied to the drops. Thus each usable drop is charged according to its intended position in the stroke. If a particular drop is not to be used then the drop is not charged and it is captured at the gutter for recirculation. This cycle repeats for all strokes in a matrix and then starts again for the next character matrix.

Ink is delivered, under pressure, to the print head by an ink supply system that is generally housed within a sealed compartment of a cabinet that includes a separate compartment for control circuitry and a user interface panel. The system includes a main pump that draws the ink from a reservoir or tank via a filter and delivers it under pressure to the print head. As ink is consumed the reservoir is refilled as necessary from a replaceable ink cartridge that is releasably connected to the reservoir by a supply conduit, with the replacement ink suitably being supplied through an ink top-up pump which is connected to an outlet port of the replaceable ink cartridge by means of the supply conduit. The ink is fed from the reservoir, suitably via a flexible delivery conduit to the print head by the main pump. The unused ink drops captured by the gutter are recirculated to the reservoir via a return conduit by a pump. The flow of ink in each of the conduits is generally controlled by solenoid valves and/or other like components.

As the ink circulates through the system, there is a tendency for it to thicken as a result of solvent evaporation, particularly in relation to the recirculated ink that has been exposed to air in its passage between the nozzle and the gutter. In order to compensate for this "make-up" solvent is added to the ink as required from a replaceable solvent cartridge so as to maintain the ink viscosity within desired limits. This solvent may also be used for flushing components of the print head, such as the nozzle and the gutter, in a cleaning cycle. A solvent top-up pump may be used for supplying the solvent from the replaceable solvent cartridge via a supply conduit.

Hence a typical continuous ink jet printer has both a replaceable ink container, or cartridge and a replaceable solvent container, or cartridge. Suitably, each container has a port through which the respective liquid, ink or solvent, is dispensed. The port for each container is connected, via fluid-tight means, to a pumping system adapted to dispense liquid from the container to the reservoir. In this description, both replaceable ink containers and replaceable solvent containers are referred to as containers or cartridges.

It is desirable to provide a simple method for monitoring the quantity of ink or solvent remaining in a container for a printer. This is because such monitoring allows for an operator of the printer to plan for replacement of the container at a suitable time, such as when the printer is not in use, without disrupting the printer's operation.

Also, it may be desirable to change the ink type or solvent type for a printer before the ink or solvent containers are empty (for instance because a different ink colour or type is needed). It is desirable to be able to re-attach such part-used containers at a later date so that ink or solvent is not wasted. It is also desirable to be able to know the amount of liquid remaining in part-used containers when they are to be re-used, either with the printer from which they were removed when partially full, or with another compatible printer.

The present invention is not necessarily limited to the field of printing devices but may also have application to other fields where replaceable liquid containers are used, such as for paint spraying, or even for medical uses such as drug dosing apparatus.

In a first aspect, the invention provides a container for storing and dispensing liquid comprising a reservoir with walls enclosing an internal space having a variable volume for storage of a liquid and a port for dispensing said liquid, wherein the reservoir is adapted to support a reduction in pressure of the internal space whereby the equilibrium pressure difference between the internal space and the surrounding atmosphere increases substantially monotonically in magnitude as liquid is dispensed, wherein the port is adapted to allow liquid to be dispensed when a withdrawal pressure at the exterior of the port is less than the equilibrium pressure of the internal space, and wherein the port is adapted to prevent air from entering the internal space from outside the reservoir as liquid is dispensed.

Suitably the container is a replaceable container for storing and dispensing ink or solvent for use with a printer, i.e. a printing device or apparatus.

Suitably, the printer is an ink jet printer, particularly a continuous ink jet printer. The liquid may be an ink such as a dye-based ink or a pigment-based ink, or may be a solvent suitable for use as a diluent for the ink or for cleaning or flushing the liquid conveying lines of the printer.

The reservoir of the container is adapted to support a reduction in the equilibrium pressure of the internal space such that the magnitude of the pressure difference between the internal space and the surrounding atmosphere increases substantially monotonically as the variable volume of the internal space reduces as liquid is dispensed. The reduction is a reduction in pressure as compared to surrounding atmospheric pressure. In other words, the pressure in the internal space will typically start out, when the reservoir is first filled, at atmospheric pressure. As liquid is dispensed, the pressure of the inner space of the reservoir, and of the liquid therein, will have an equilibrium value which is less than atmospheric pressure, and this equilibrium value of the pressure in the internal space will continue to become smaller as more liquid is dispensed from the inner space. Liquids are incompressible, and so when liquid generally is removed from a closed internal space, the removed liquid must be either replaced by another fluid, typically gas, usually air, or the volume of the closed space must decrease in order to compensate for the lost liquid. If the reservoir enclosing the internal space is rigid, then gas must enter to allow liquid to be removed. If the reservoir is permanently or plastically deformable, such as the reservoir of a toothpaste tube, then the removal of liquid leads to the atmospheric pressure outside the tube squeezing the reservoir such that the internal space is reduced to compensate for the lost liquid. For the present invention, the reservoir of the container is such that it will deform in order to allow the internal space to be reduced to compensate for the loss of liquid dispensed through the port, but the deformation of the reservoir leads to a reduction in the pressure inside the internal space. If it is desired to extract or dispense more liquid from the internal space of the reservoir, through the port, it will be necessary to reduce the pressure at the exterior of the port to a value that is less than the equilibrium pressure in the internal space of the reservoir whereby liquid may flow out through the port. This in turn leads to further decrease in the internal volume of the reservoir, and an even lower pressure inside the internal space.

The walls of the reservoir are such that they able to support the pressure differential between the internal space and the surrounding atmosphere.

As liquid is dispensed from the internal space of the reservoir through the port, the pressure to be applied at the port in order to suck the liquid out through the port will decrease substantially monotonically as the reservoir is emptied.

For any particular container according to the invention, there will be a relationship between the minimum withdrawal pressure required to allow dispensing and the volume of the internal space. By means of this relationship, and by measuring the minimum withdrawal pressure required in order to dispense liquid through the port of the cartridge, it is possible to derive the volume remaining in the internal space of the reservoir, and hence to deduce the volume of liquid remaining in the container.

Hence, a second aspect of the invention provides a method for measuring the volume of liquid in a container comprising the steps of:

i) providing a container for storing and dispensing liquid comprising a reservoir with walls enclosing an internal space having a variable volume for storage of a liquid and a port for dispensing said liquid, ii) connecting the port to an inlet of a pumping means of the printer by a fluid-tight connection, iii) operating the pumping means to form a withdrawal pressure at the exterior of the port, iv) measuring the minimum withdrawal pressure required to allow dispensing of liquid through the port, and v) determining the volume of liquid from the measured minimum withdrawal pressure.

Typically, the volume of liquid is determined from a known relationship between the minimum withdrawal pressure required to allow dispensing and the volume of the internal space.

This method is particularly useful for measuring the volume of liquid in a replaceable container attached to a printer such as an ink jet printer or a continuous ink jet printer.

Hence a third aspect of the invention provides an ink jet printer having a container removably attached thereto and a pumping means, the container comprising a volume of liquid substantially filling the volume of the internal space of the reservoir of the container and having the port of the reservoir connected to an inlet of the pumping means of the ink jet printer by a fluid-tight connection, wherein the pumping means is adapted to form a withdrawal pressure at the exterior of the port of the reservoir, the ink jet printer further comprising a pressure measurement means for measuring the withdrawal pressure and a control means for determining the volume of liquid in the internal space of the reservoir of the container from a minimum liquid withdrawal pressure measured by the pressure measurement means.

The container may be in accordance with the first aspect of the present invention.

The ink jet printer of the third aspect of the invention is suitably a continuous ink jet printer.

The preferred features and embodiments of the invention, as detailed in the following description, apply to the first, second and third aspects of the invention where appropriate.

The invention is based upon the following physical principles. If no force acts normal to a tensioned surface, then the surface will remain flat. If the pressure on one side of the surface differs from pressure on the other side, the pressure difference times surface area results in a normal force. In order for equilibrium to be established, the tension forces in the tensioned surface must cancel the force due to pressure, and this leads to the surface becoming curved. Probably the most well-known application of this principle is a child's balloon, where the gas pressure inside the balloon is greater than the atmospheric pressure outside the balloon, with the pressure difference compensated by the tension in the curved elastic surface of the balloon. The pressure is generally greater on the concave side of a tensioned surface when the initial, untensioned surface is flat. However, if the initial, untensioned surface is concave initially, when the pressure on each side of the surface is the same, then reducing the pressure on the concave side of the surface can lead to it remaining concave, but with a greater radius of curvature, as tension is established in the surface to provide equilibrium.

Suitably, the reservoir of the container comprises a rigid framework and one or more elastically deformable sections. For instance, a rubber membrane, such as a balloon, stretched over a rigid skeleton in the form of a rectangular parallelepiped could be a suitable reservoir, with a valved opening in the balloon forming the port. As liquid is removed from the reservoir through the valved port, the rubber membrane would become convex towards the internal space leading to an equilibrium pressure difference between the internal space and the outside of the reservoir (the outside of the reservoir will be at atmospheric pressure, which remains relatively constant). If the atmospheric pressure is P, and the pressure in the internal space is $P_I$, where $P_I<P$ then the pressure required to withdraw liquid through the valved port will be $P_w$, where $P_W<P_I$. This pressure difference (pressure reduction) will increase substantially monotonically in magnitude as more liquid is removed from the reservoir. By increasing substantially monotonically, it is meant that a decrease in the volume of liquid generally leads to an increased magnitude of pressure difference, although minor deviations from this behaviour (say of a decrease of no more than 10% in pressure difference before decrease is continued, preferably no more than 5%, more preferably no more than 1%) may be tolerated provided that the overall trend is an increase in magnitude of pressure difference as volume of liquid decreases.

By rigid it is meant that the framework does not deform substantially, when the pressure difference between the inner space of the reservoir and the outside is up to 50 kPa, preferably up to 70 kPa.

Preferably, the rigid framework of the reservoir is formed by edges joining the walls of the reservoir, and at least one wall is elastically deformable, such that tension can develop in the at least one deformable wall as the volume of the internal space is decreased as liquid is dispensed from it. Suitably, all of the walls of the reservoir are elastically deformable. The angle between the walls where they join at their edges confers rigidity upon these edges.

Preferably, the walls form a box-shaped reservoir comprising two opposed face walls of similar shape joined at their perimeters by edge walls having their width substantially normal to the opposed parallel faces. Suitably, the edge walls have a width which is less than 30% of the smallest width of the opposed face walls, preferably less than 20%. This allows the opposed face walls to deform smoothly towards each other as the internal space reduces as liquid is dispensed. The opposed face walls are suitably substantially mutually parallel.

Suitably, the walls are of an elastic polymer such as high density polyethylene. Any suitable elastic material may be used for the walls. In order for the reservoir to be refilled, no permanent deformation should occur in the reservoir, even when the pressure of the internal space has been reduced to 50 kPa or less, preferably 40 kPa or less, more preferably 20 kPa or less. Atmospheric pressure is about 100 kPa or 1 Bar.

The reservoir may be formed from a thermoplastic material, suitably by blow moulding. Suitably, the reservoir and port may be formed as a blow-moulded item.

The container may simply be the reservoir and port, but suitably these may be provided with a rigid cover to facilitate handling.

The relationship between the volume of the internal space of the reservoir and the withdrawal pressure $P_W$, necessary to allow liquid to be dispensed through the port will depend upon the shape, materials, thickness, Young's modulus, etc. of the reservoir materials. The relationship could be calculated, but is preferably measured experimentally for each particular reservoir design. This can be easily achieved, for instance by the following steps:

i) provide the container with the internal space filled with a known volume of liquid and at the same pressure as the outside, atmospheric pressure, ii) attaching the port to a dispensing conduit by means of a fluid-tight connection, iii) withdrawing a volume of liquid through the port by means of a pump attached to the dispensing conduit, iv) measuring the volume of liquid removed (for instance by weighing or volumetric measurement) and the corresponding pressure $P_W$ in the conduit (for instance by means of a pressure gauge such as a transducer), v) calculating the volume of liquid remaining in the reservoir, vi) repeating steps (iii) to (iv) to obtain the relationship between the volume of liquid remaining and the withdrawal pressure $P_w$.

In order to put the method of the invention into effect, the information concerning the relationship between the minimum withdrawal pressure required to allow dispensing and the volume of the internal space may be supplied with each container. Suitably, the containers may be made to identical manufacturing specifications, such that within manufacturing tolerances, all containers have the same relationship between the minimum withdrawal pressure required to allow dispensing and the volume of the internal space may be supplied with each container.

The use of the container of the invention is described below with reference to a continuous ink jet printer, but a similar method of use would apply to other devices.

When the container is used with a device such as a printer, it is attached to the printer, with the port of the container attached to a liquid inlet conduit by a fluid-tight connection, fluid will be drawn from the container, through the port, for instance by a top-up pump controlled by a control means for the printer. The liquid will be delivered by the pump to the ink storage tank of the printer, from where it may be directed to the print head. Typically, the control means for the printer will comprise a software program running on a microprocessor chip, controlling the operation of the printer. The minimum withdrawal pressure required to allow dispensing of liquid through the port can be measured, for instance by means of a pressure gauge or a transducer located between the top-up pump and the port of the container. The control means can then use the relationship between the measured withdrawal pressure Pw and the volume of the internal space of the reservoir in order to calculate the volume of liquid remaining in the container. Another method of measuring the pressure, by indirect means, is to measure the power required to operate the top-up pump when it is withdrawing liquid from the reservoir, and using a known relationship between pump power input and pressure drawn by the pump to deduce or calculate the minimum withdrawal pressure $P_W$.

The calculated value of the volume of liquid remaining in the container may be used in various ways. For instance it may be displayed on a display means, or it may be used to provide a warning signal to an operator that a refill will be needed when the calculated value of the volume falls below a certain level.

In order for the invention to operate reliably, it is evident that it important to avoid fluid, such as air, bleeding into the internal space of the reservoir following removal of liquid. This is achieved by ensuring that the port is provided with a fluid-tight seal or valve which does not allow fluid to enter the internal space from the outside. Suitably, the port is adapted to mate with a connector on a device with which the container is to be used so as to form a fluid tight connection. Any suitable fluid tight connection arrangement may be used, such as is well known in the art for hydraulic linkages.

One suitable arrangement for controlling the dispensing of liquid, without air entering the inner space of the reservoir is for the port to be provided with a self-sealing septum, pierced by a hollow tube or needle when the replacement cartridge is in use. Liquid may be drawn through the hollow tube, by a pump to which the tube is connected by a fluid-tight connection. When the container is removed from the device with which it is being used, such as a printer, the hole in the septum seals itself, preventing the ingress of fluid such as air into the internal space of the reservoir. Suitable material for such a septum is silicone rubber or butyl rubber, preferably provided with a PTFE lining.

Another suitable arrangement for the port is to provide it with a valve adapted to remain closed to flow of fluid when the pressure on the reservoir side of the valve is lower that the pressure on the outside of the valve, and adapted to open to flow of fluid when the pressure on the outside of the valve is lower than the pressure on the inside of the valve. A suitable valve would be a flap, hinge or diaphragm valve. When the container is in use, the outer side of the valve would be in fluid-tight connection with a pump via a conduit, such that liquid would be dispensed through the valve when the pressure in the conduit is reduced by the pump to a value less than the pressure inside the internal space of the reservoir. When the container is removed from fluid-tight connection with the pump, the pressure at the outside of the valve will increase to atmospheric pressure, closing the valve to fluid flow and preventing the ingress of air into the internal space of the reservoir.

The invention will still operate if small quantities of gas, such as air, are present in the internal space of the reservoir, but these should be less than 10% by volume of the initial volume of liquid, preferably less than 5%, more preferably less than 1%. This is what is meant by the statement that the internal space of the reservoir is substantially filled with liquid. The operation of the method of the invention should be such that the pressure in the internal space of the reservoir does not fall below the equilibrium vapour pressure of the liquid at the temperature of operation. This would lead to the formation of vapour in the internal space of the reservoir and the removal of liquid from the internal space would result in no further reduction in the pressure of the internal space, which would remain at the equilibrium vapour pressure of the liquid at that temperature.

Preferably, the container comprises an electronic data storage means storing the relationship between the minimum withdrawal pressure required to allow dispensing and the volume of the internal space for the container, whereby the relationship can be read from the electronic data storage means.

Suitably, the control means for the device using the container, such as a printer, will be adapted to read the data on the electronic data storage means of the container. For instance, when the container is in place on such a device, electrical contacts on the electronic data storage means may be in placed in physical contact with electrical leads attached to the control means, whereby the control means can access and read the data on the electronic data storage means.

The measured volume of liquid, as calculated, for instance by the control means, may be written to the electronic data storage means whereby the volume of liquid remaining in the container can be monitored by reading the electronic data storage means. This gives the advantage that if the container is detached from a printer when still containing liquid, the amount of liquid remaining in the container may be read directly from the electronic data storage means, without the need to measure the minimum withdrawal pressure required to dispense liquid through the port of the reservoir. Other information may also be stored on the electronic data storage means, for instance the number of times that the container has been refilled. Such data may be used to retire the container once a maximum number of refills has been exceeded. In order to prevent illicit refilling of retired containers, such data may be stored in a manner such that it cannot be overwritten or cleared once the container has been retired (for instance by using memory which is writable only once).

Figure 2:
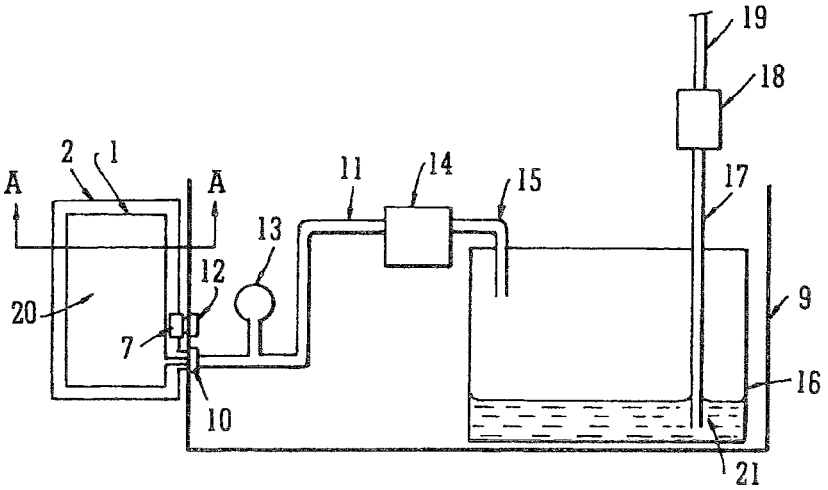
Figure 3A:
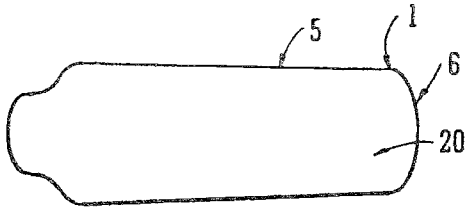
Figure 3B:
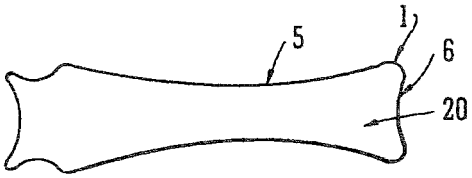
Figure 4:
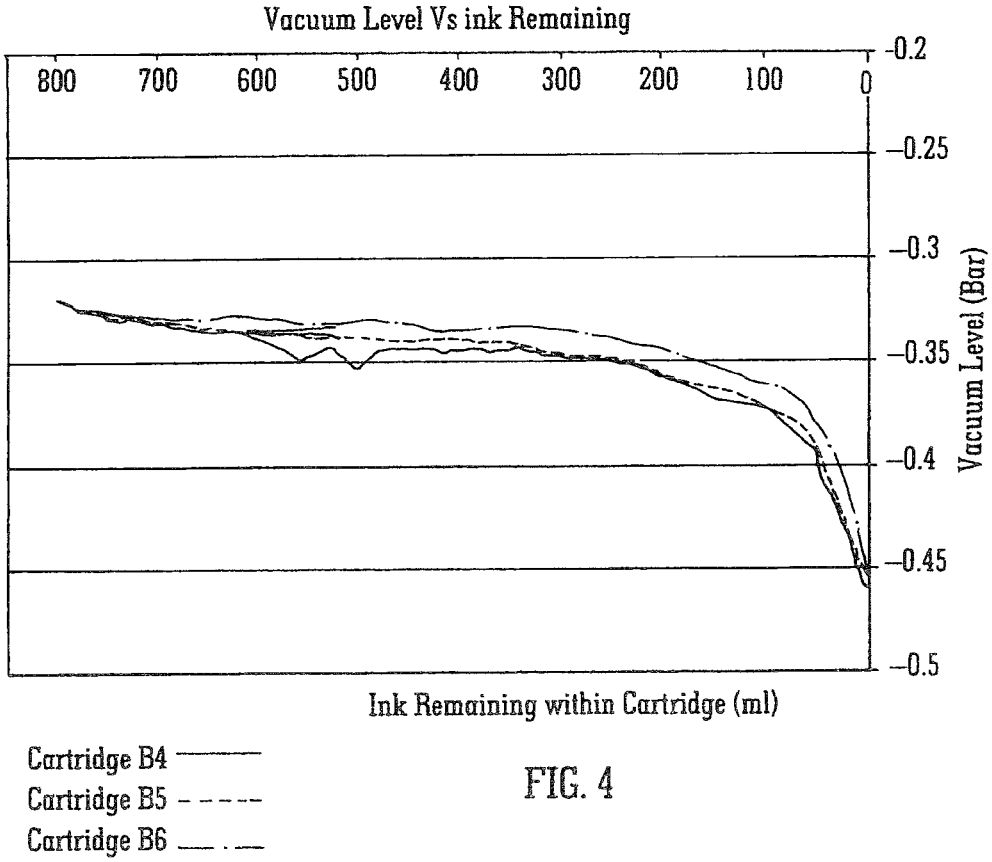

Specific embodiments of the present invention will now be described, by way of example only, with reference to the accompanying drawings in which:

FIG. 1 is an exploded, perspective view of a replacement cartridge according to the invention, FIG. 2 is a schematic representation of part of a continuous ink jet printer fitted with a replacement cartridge which is a container according to the present invention;

FIG. 3 is a cross sectional view through the reservoir of a replacement cartridge along the section A-A shown in FIG. 2, with FIG. 3A showing the reservoir when full of liquid and FIG. 3B the reservoir partly full of liquid; and FIG. 4 is a graph showing the relationship between the minimum pressure required for dispensing, measured at the exterior of the dispensing port, and the volume of ink remaining in the internal space of the reservoir of the example replacement cartridge according to the invention.

In FIG. 1, a replacement cartridge 2, which is a container according to the invention, is shown with a reservoir 1 which is encased in a protective rigid chamber 8. The rigid chamber 8 is provided with apertures so that the outside of the reservoir 1 is subject to atmospheric pressure at all times. The reservoir has a port 3 providing an aperture between the internal space of the reservoir and the outside. The port is fitted with a septum seal 4. The reservoir is in the form of two opposed parallel face walls 5 joined at their perimeters by edge walls 6. An electronic storage device in the form of an integrated circuit 7 provided with electrical contacts 8*a* is held as part of the protective rigid chamber.

Referring to FIG. 2, the replacement cartridge 2 is attached to a printer 9 with the septum seal 4 on the port 3 attached to a fluid-tight connector 10 on the printer 9. Ink 20 fills the internal space of the reservoir 1. A hollow tube (not shown) pierces the septum seal 4 to allow fluid connection between the internal space of the reservoir 1 and a dispensing conduit 11. The electronic storage device 7 is in electrical contact with a contact pad 12 on the printer 9 by means of the electrical contacts 8*a*. The contact pad 12 is in electrical communication with the control system (not shown) of the printer 9. A pressure gauge 13 is also present in fluid connection with the delivery conduit, as is a pump 14. The pump outlet conduit 15 feeds into the ink tank 16 containing ink 21 and a tank emptying conduit 17 is connected to a print head pump 18 whose outlet is connected to a print head delivery conduit 19.

In use, the pump 14 reduces the pressure in the delivery conduit 11 until the pressure in the delivery conduit 11 is lower than the pressure in the internal space of the reservoir 1. This leads to the liquid 20 being dispensed from the reservoir 1, through the delivery conduit 11, through the pump 14 and via the outlet conduit 15 to join the ink 21 in the tank 16. The pressure gauge 13 measures the minimum withdrawal pressure in the delivery conduit 11 required for ink 20 to be dispensed and sends this measurement to the control system (not shown) of the printer 9. From the electronic storage device 7, data concerning the relationship between the minimum withdrawal pressure required to allow dispensing and the volume of the internal space 20 is read by the control system (not shown) via the contact pad 12 and the electrical contacts 8*a* on the electronic storage device 7.

The control system uses the minimum withdrawal pressure as measured by the pressure gauge 13 and the relationship read from the electronic storage device 7 in order to calculate and display the volume of ink 20 remaining in the internal space of the reservoir 1 on a display means (not shown).

Referring to FIG. 3, this shows a cross sectional view though the reservoir 1 along the section A-A shown in FIG. 2. FIG. 3A shows the reservoir's cross section when the reservoir 1 is full of ink 20 and the pressure in the internal space of the reservoir 1 is the same as the surrounding atmospheric pressure. In FIG. 3B, the pressure in the internal space of the reservoir has been reduced by removal of ink from the reservoir. In order to provide equilibrium, the face walls 5 and edge walls 6 have become concave towards the outside of the reservoir and are under tension, with the force arising from the tension in the curved walls balancing the pressure difference between the internal space of the reservoir and the outside of the reservoir (at atmospheric pressure).

The graphs of FIG. 4 illustrate the relationship between the internal pressure and the volume of liquid in cartridges of the kind described above. The minimum pressure is expressed as vacuum level in Bar, so a vacuum level of −0.4, for instance, corresponds to a pressure of 0.4 Bar less than the ambient pressure of 1 Bar, corresponding to about 0.6 Bar at the port and hence also in the inner space. Graphs are shown for three different cartridges, B4, B5 and B6, manufactured to the same specifications, as detailed above.

It can be seen that the reduction in pressure as volume decreases (the slope of the curves) is steeper when the cartridge is nearly empty. It can also be seen that the pressure decreases substantially monotonically as the volume remaining decreases. Cartridge B4 shows small pressure increases at some volumes, but the overall trend is for a monotonic decrease in pressure corresponding to a monotonic increase in the magnitude of the pressure reduction from ambient pressure.

It will be appreciated that numerous modifications could be made to the embodiment detailed above without departing from the scope of the invention as detailed in the claims. For instance, the liquid in the replacement cartridge could be solvent rather than ink, or a valve arrangement could be used rather than a septum seal. For instance, the data concerning the relationship between the minimum withdrawal pressure required to allow dispensing and the volume of the internal space 20 could be stored on the control system rather than read from an electronic storage device forming part of the replacement cartridge.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

What is claimed is:

1. A method for measuring the volume of printing liquid in a fluid container for an ink jet printer comprising the steps of:

i) providing a container for storing and dispensing printing liquid, the container comprising a reservoir with walls enclosing an internal space having a variable volume for storage of the liquid and a port for dispensing the liquid;

ii) connecting the port to an inlet of a pump of the printer by a fluid-tight connection;

iii) operating the pump to form a withdrawal pressure at the exterior of the port;

iv) measuring the minimum withdrawal pressure required to allow dispensing of liquid through the port; and v) determining the volume of liquid from the measured minimum withdrawal pressure, wherein the container is for storing and dispensing ink or solvent for use with a continuous inkjet printer, wherein the reservoir is adapted to support a reduction in pressure of the internal space whereby the equilibrium pressure difference between the internal space and the surrounding atmosphere increased substantially monotonically in magnitude as liquid is dispended;

wherein the port is adapted to allow liquid to be dispensed when a withdrawal pressure at the exterior of the port is less than the equilibrium pressure of the internal space; and wherein the port is adapted to prevent air from entering the internal space from outside the reservoir as liquid is dispensed, the container comprising a volume of liquid substantially filling the volume of the internal space.

2. A method according to claim 1, wherein the volume of liquid is determined from a known relationship between the minimum withdrawal pressure required to allow dispensing and the volume of the internal space.

3. A method according to claim 1, wherein the container comprises an electronic data storage device and the measured volume of liquid is written to the electronic data storage device whereby the volume of liquid remaining in the container can be monitored by reading the electronic data storage.

4. A method according to claim 1, wherein the container comprises an electronic data storage device storing the relationship between the minimum withdrawal pressure required to allow dispensing and the volume of the internal space for the container, whereby the relationship can be read from the electronic data storage device.

5. A method according to claim 1, wherein the reservoir comprises a rigid framework and one or more elastically deformable sections.

6. A method according to claim 5, wherein the rigid framework is formed by edges joining the walls and at least one wall is elastically deformable.

7. A method according to claim 1, wherein the walls form a box-shaped reservoir comprising two opposed face walls of similar shape joined at their perimeters by edge walls having their width substantially normal to the opposed parallel faces.

8. A method according to claim 1 wherein the port is provided with a self-sealing septum.

9. A method according to claim 1 wherein the container further comprises a rigid cover.

10. A method according to claim 1 where no permanent deformation occurs in the reservoir when the pressure of the internal space is reduced to 40 kPa or less.

* * * * *